US007678471B2

(12) United States Patent
Park et al.

(10) Patent No.: US 7,678,471 B2
(45) Date of Patent: Mar. 16, 2010

(54) SURFACE MODIFICATION TO IMPROVE FIRESIDE CORROSION RESISTANCE OF FE-CR FERRITIC STEELS

(75) Inventors: Jong-Hee Park, Clarendon Hills, IL (US); Krishnamurti Natesan, Naperville, IL (US); David L. Rink, Mokena, IL (US)

(73) Assignee: UChicago Argonne LLC, Chicago, IL (US)

( * ) Notice: Subject to any disclaimer, the term of this patent is extended or adjusted under 35 U.S.C. 154(b) by 49 days.

(21) Appl. No.: 11/374,849

(22) Filed: Mar. 14, 2006

(65) Prior Publication Data

US 2007/0037009 A1 Feb. 15, 2007

Related U.S. Application Data

(60) Provisional application No. 60/707,120, filed on Aug. 10, 2005.

(51) Int. Cl.

| | |
|---|---|
| ***C25D 5/10*** | (2006.01) |
| ***C23C 8/00*** | (2006.01) |
| ***C23C 22/00*** | (2006.01) |
| ***C23C 8/06*** | (2006.01) |

(52) U.S. Cl. ..... 428/682; 148/240; 148/279

(58) Field of Classification Search ..... 428/682; 148/279, 240

See application file for complete search history.

(56) References Cited

U.S. PATENT DOCUMENTS

| | | | | |
|---|---|---|---|---|
| 1,869,980 | A * | 8/1932 | Osborg | 420/8 |
| 3,343,928 | A * | 9/1967 | Bellis et. al. | 428/667 |
| 5,769,966 | A * | 6/1998 | Park | 148/242 |
| 6,592,941 | B1 * | 7/2003 | Bayer et al. | 427/253 |

* cited by examiner

*Primary Examiner*—Roy King
*Assistant Examiner*—Caitlin Fogarty
(74) *Attorney, Agent, or Firm*—Foley & Lardner LLP

(57) ABSTRACT

An article of manufacture and a method for providing an Fe—Cr ferritic steel article of manufacture having a surface layer modification for corrosion resistance. Fe—Cr ferritic steels can be modified to enhance their corrosion resistance to liquid coal ash and other chemical environments, which have chlorides or sulfates containing active species. The steel is modified to form an aluminide/silicide passivating layer to reduce such corrosion.

14 Claims, 2 Drawing Sheets

SURFACE MODIFICATION TO IMPROVE FIRESIDE CORROSION RESISTANCE OF FE-CR FERRITIC STEELS

CROSS-REFERENCE TO RELATED PATENT APPLICATIONS

This application claims priority to U.S. Provisional Patent Application No. 60/707,120 filed on Aug. 10, 2005, and this application is incorporated herein by reference.

The United States Government has certain rights in the invention pursuant to Contract No. W-31-109-ENG-38 between the U.S. Department of Energy and the University of Chicago operating Argonne National Laboratory.

The invention relates to a method and system for surface layer modification of Fe—Cr ferritic steels for improved resistance to various corrosive environments. More particularly the invention relates to an article of manufacture and a method and system for surface modification of Fe—Cr ferritic steels to improve corrosion resistance to alkali sulfates and alkali chlorides, such as are present in liquid phase coal ash.

BACKGROUND OF THE INVENTION

Fe—Cr ferritic steels, and other bulk alloys of steel, have conventionally been used to provide corrosion resistant structures for a wide variety of applications. High temperature fireside metal corrosion, or "wastage," in conventional coal-fired steam generators can be caused by gas-phase oxidation or liquid phase coal-ash corrosion. While gas phase corrosion does not typically cause corrosion problems for properly selected ferritic steels, liquid phase coal ash corrosion can be a serious problem. Such coal ash corrosion can rapidly degrade a wide variety of steels normally used for their corrosion resistant properties. In particular, the presence of alkali chlorides, such as NaCl in the coal ash deposit, can lead to catastrophic metal corrosion in the range of about 650° C.-800° C.

SUMMARY OF THE INVENTION

An improved article of manufacture, composition of matter and method and system of manufacture are provided for modification of the surface chemistry of Fe—Cr ferritic steels to achieve resistance to fireside corrosion and also provide a passivating protective layer to reduce other forms of corrosion, such as degradation of Fe—Cr ferritic steels used in numerous types of corrosive chemical environments or even for applications where the material is subject to a high energy plasma.

In this invention the surface of Fe—Cr ferritic steels is modified to prevent and/or minimize transport of chlorine ions, sulfur ions and/or chloride or sulfide species to form a protective or passivating Cr-rich oxide scale on an underlying Fe—Cr ferritic steel substrate. The protective layer is obtained most preferably by contacting the Fe—Cr ferritic steels with a solution of Si and Al dissolved in lithium at temperatures in the range of 600-650° C. and for times in the range of 1-2 hours or other time periods sufficient for the dissolved Si and Al to react with a surface transition metal, such as Fe and Cr, to form a silicide and/or aluminide coating. The coating process is preferably done under a vacuum or inert atmosphere. In one example, Li together with Si (in powder form) and Al also (in powder form) is sealed in a gas tight stainless steel capsule together with a number of Fe-based alloy specimens. After heating to appropriate temperatures to melt the Li and dissolve the Si and Al powder in the molten Li to form a mixture, the specimens were coated with the liquid metal mixture. After coating was complete, the capsule was opened and the liquid metal mixture was drained. A small amount of methanol can be used to dissolve any residual Li from the specimen surfaces. Subsequent testing of the coated specimens was performed in an environment containing low concentrations of NaCl in an air atmosphere containing $SO_2$ at 650° C. The coated specimens exhibited virtually no corrosion when compared with those without the coating. Further details are provided in Example 1.

Various aspects of the invention are described hereinafter, and these and other improvements are described in greater detail below, including the drawings described in the following section.

DETAILED DESCRIPTION OF PREFERRED EMBODIMENTS

Figure 1:
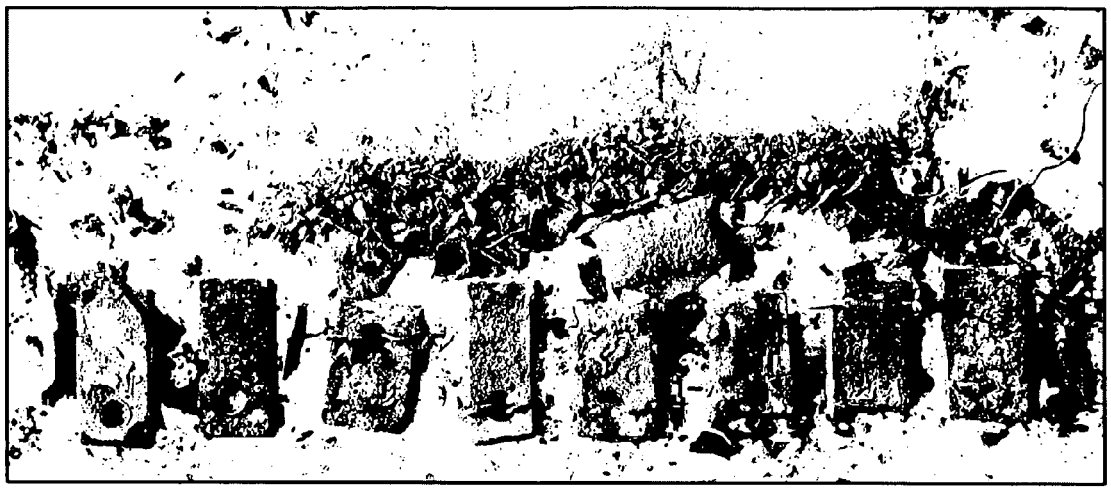
FIG. 1 illustrates four different Fe—Cr ferritic steel alloy specimens in an untreated condition subject to a 1 vol. % $SO_2$ plus 300 vppm NaCl for a period of 100 hours in air.
Figure 2:
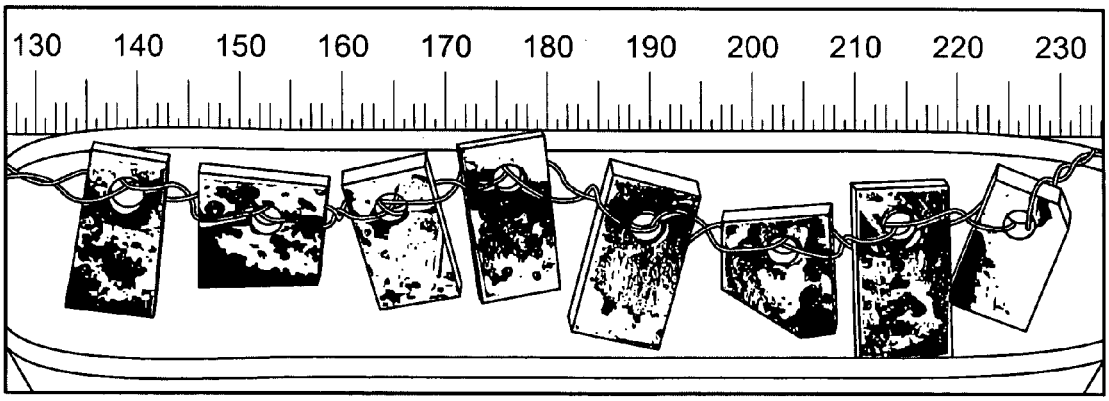
FIG. 2 illustrates corrosion performance for the same alloy of FIG. 1 but with surface modification of the Fe—Cr ferritic steel performed in accordance with the method of the invention.
Figure 3:
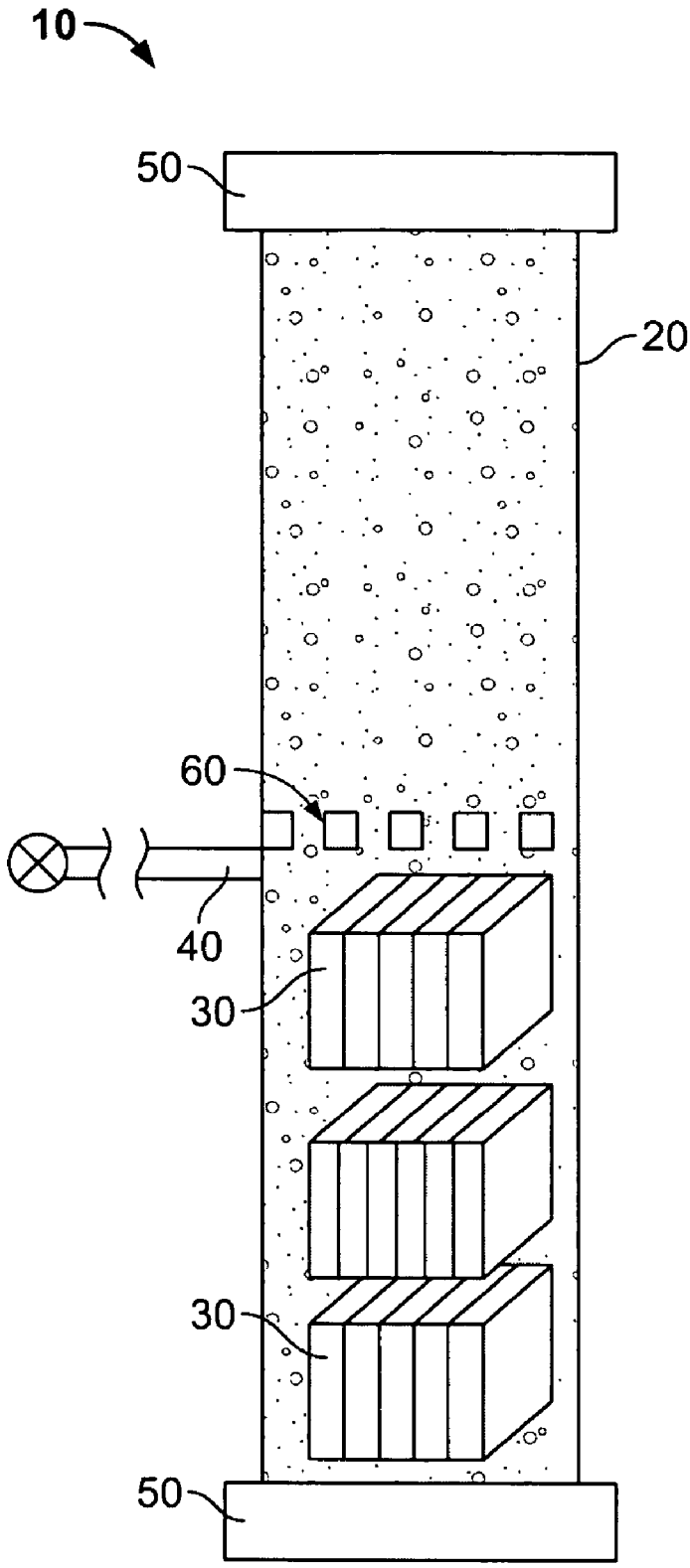
FIG. 3 illustrates a system for surface modification of Fe—Cr ferritic steels.

A system and method for surface modification of Fe—Cr ferritic steels is shown in FIG. 3. A system 10 includes a chamber 20 for receiving Fe—Cr ferritic steels specimens 30. An inlet/outlet port 40 can be used for evacuation of the chamber 20 and/or input of selected gases, such as inert gases, $SO_2$ and $N_2$, to control the surface modification methodology. The system 10 also includes screw caps 50 and a liquid metal drain mechanism 60.

In order to achieve protection from corrosive environments, such as liquid phase coal ash at elevated temperatures, a passivating, surface modified layer, is established on the Fe—Cr ferritic steel. In general, the surface modified layer is created by chemically modifying the Fe—Cr steel to achieve a surface layer composition which is an aluminide/silicide layer formed in conjunction with the base Fe—Cr ferritic composition. Preferably the resulting article of manufacture has a passivating layer of about 1.0 micrometer thickness or greater and is formed by subjecting the base steel structures to a mixture of aluminum and silicon powder in a controlled gas atmosphere at an elevated temperature to react with the steel. Most preferably the aluminum/silicon powder is also combined with Li solid, and then the temperature is increased to melt the Li to form a liquid mixture, which causes the chemical reaction to proceed between the Fe—Cr ferritic steel and the aluminum/silicon powder mixture. The atmosphere above the Fe—Cr ferritic steel is preferably controlled to optimize formation of the surfaced modified, protective layer on the Fe—Cr ferritic steel. The gas atmosphere and temperature in the chamber 20 can be adjusted to accelerate or decrease growth rate. The resulting articles of manufacture can then be further processed for use in specific environmental application, such as for use in coal-fired stem generators or any other corrosive environment, particularly where subjected to liquid phase coal ash. Applications are particularly advantageous when the steel is subject to a chloride or sulfide, such as NaCl or $Na_2SO_4$.

The following non-limiting example describes one method of processing Fe—Cr ferritic steels to form the surface modified layer.

EXAMPLE 1

Surface modification of an Fe—Cr based alloy was performed to improve corrosion protection from the environment containing low concentrations (0-500 vppm) NaCl in air containing 1% $SO_2$ at 650° C. The surface modification on the Fe-based alloys was performed as follows: Loaded 4 g Li (mp=180° C., volume≈8 ml) in a wire mesh plus 1-2 wt. % Si (in powder form) plus 0.1-0.5 wt. % Al (in powder form) inside a SS304 tube and sealed with a Swagelock fitting to make it gas tight. Three stacks of specimens were inserted into the capsule as shown schematically in FIG. 3. The three stacks of specimens were identified as lower, middle, and top stacks. Upon completion of the coating process, the chamber was flipped to drain the liquid metal mixture and then cooled. The top cap screw was opened and the coated specimens were retrieved. Retrieval was aided by using a small amount of methanol to dissolve the residual lithium on the specimen surfaces. The specimens were stored in a dry desiccator for subsequent use in corrosion tests involving NaCl. Specimens were rinsed in water and alcohol and visually examined by scanning electron microscopy (SEM) and chemical information was obtained by the energy dispersive X-ray (EDX) analysis. SEM/EDX was also performed on the cross section of the coated specimens. A pure silicide coating had less than desirable adhesion to the substrate alloy, based on the SEM analysis. Addition of a small amount of Al resulted in good adhesion for the Fe-based substrates and also showed better corrosion protection. We can identify several advantageous attributes for this coating process and the resulting composition and article of manufacture:

1. The coating system can be simple and can be designed to coat simple as well as complex geometries.
2. The process is conducted at relatively low temperatures, which is beneficial since most Fe-base alloy constituents do not dissolve in liquid lithium, except elements such as Si and Al. the dissolved Si and/or Al can react with transition metals, such as Fe and Cr, to form a silicide and/or aluminide coating.
3. Addition of a small amount of Al improves the adhesion of the coating to the substrate.
4. The liquid metal can be recycled/reused for continued coating development.
5. System can be scaled as needed, based on component size and geometry.
6. Since the process involves liquid metal to develop the coating, it can be applied to develop coatings not only on structural components but also to develop thin coatings on fine particles.

It should be understood that various changes and modifications referred to in the embodiment described herein would be apparent to those skilled in the art. Such changes and modifications can be made without departing from the spirit and scope of the present invention.

What is claimed:

1. An article of manufacture, comprising:

an Fe—Cr ferritic steel substrate;

a passivating layer having a composition selected from the group consisting of an Fe—Cr aluminide and an Fe—Cr silicide, the passivating layer formed by reaction of aluminum or silicon with the Fe—Cr ferritic steel substrate in the presence of lithium wherein a lithium solid is melted and the Fe—Cr ferritic steel and aluminum or silicon react to form a surface-modified layer on the Fe—Cr ferritic steel substrate; and residual lithium present on the passivating surface layer.

2. The article as defined in claim 1 wherein the passivating layer has a thickness of about 1.0 micrometer or greater.

3. The article as defined in claim 1 wherein the passivating layer is formed by the process of subjecting the Fe—Cr ferritic steel substrate to a mixture of the aluminum and the silicon in a powder form.

4. The article as defined in claim 3 wherein the process further includes establishing a controlled gas atmosphere at an elevated temperature.

5. The article as defined in claim 4 wherein the controlled gas atmosphere and the elevated temperature can be adjusted to control rate of growth of the passivating surface layer.

6. The article as defined in claim 3 wherein the amount of silicon consists essentially of about 1-2 wt. % Si.

7. The article as defined in claim 3 wherein the amount of aluminum consists essentially of about 0.1-0.5 wt. %.

8. The article as defined in claim 3 wherein the mixture includes lithium in an amount of 4 grams, about 1-2 wt. % silicon and about 0.1-0.5 wt % aluminum.

9. A method of processing the article of manufacture of claim 1 to provide protection against fireside metal corrosion, comprising the steps of:

providing an Fe—Cr ferritic steel substrate;

applying a mixture of silicon and aluminum to the substrate;

combining the mixture of silicon and aluminum with a lithium solid; and elevating temperature of the substrate and the mixture of silicon, aluminum, and lithium to cause formation of aluminides and silicides of Fe—Cr ferritic steel;

wherein the lithium solid is melted and the Fe—Cr ferritic steel and the mixture of silicon and aluminum react to form a surface-modified layer on the Fe—Cr ferritic steel substrate.

10. The method as defined in claim 9 further including the step of creating a controlled gas atmosphere during the step of elevating temperature.

11. The method as defined in claim 9 wherein the method results in creating a passivating layer with a thickness of about 1.0 micrometer or greater.

12. The method as defined in claim 9 further including the step of controlling growth rate of the passivating layer by control of a gas atmosphere in combination with changing the temperature of the substrate.

13. The method as defined in claim 9 wherin the mixture consists essentially of about 1-2 wt. % silicon, about 0.1-0.05 wt % A1.

14. The method as defined in claim 13 further including the step of including 4 g of lithium.

* * * * *